United States Patent [19]

Wilcek

[11] Patent Number: 4,735,324

[45] Date of Patent: Apr. 5, 1988

[54] REMOVABLE SHELF SEPARATOR AND SYSTEM

[75] Inventor: Joe E. Wilcek, Elmhurst, Ill.

[73] Assignee: H. King & Associates, Ltd., Bensonville, Ill.

[21] Appl. No.: 907,116

[22] Filed: Sep. 12, 1986

[51] Int. Cl.[4] ..... A47F 5/00

[52] U.S. Cl. ..... 211/184; 211/94; 220/22.5

[58] Field of Search ..... 211/184, 87, 94, 162; 108/61; 220/22.1, 22.2, 22.3, 22.5

[56] References Cited

U.S. PATENT DOCUMENTS

| | | | |
|---|---|---|---|
| 2,688,409 | 9/1954 | Echlin | 211/184 |
| 3,579,710 | 5/1971 | Gartzke | 211/184 X |
| 4,572,380 | 2/1986 | Langwell | 211/57.1 |

*Primary Examiner*—Ramon S. Britts
*Assistant Examiner*—Blair M. Johnson
*Attorney, Agent, or Firm*—Donald A. Peterson

[57] ABSTRACT

A movable and removable product separator unit and a retaining and support system therefor for easy adjustable separation organization and display of goods in a point-of-purchase vending is provided.

The separator unit comprises a T-shaped insertion member and an integrally formed product separation member of flexible, semi-rigid plastic material which is insertable into, removable from and movable in a pair of grooves in a retaining and support member mounted in a display construction or vending unit to provide varied and adjustable spaces for the display and organization of products offered for sale.

10 Claims, 4 Drawing Sheets

REMOVABLE SHELF SEPARATOR AND SYSTEM

BACKGROUND OF THE INVENTION

1. Field of the Invention

This invention relates to moveable and removable shelf separator systems useful in assisting in the separation, organization and display of goods on a shelf for convenience and point-of-purchase consumer vending.

2. Description of the Prior Art

Point-of-purchase vending and display systems are increasingly important in retailing of relatively small regularly-shaped convenience items at supermarket check-out counters, cigar, cigarette and retailing locations. These may include such items as cigarettes, packaged candy, gum and mints, packaged cookies, film or the like. Such items are customarily stocked so as to give a customer or clerk a wide and accessible selection of the various items, each stocked in its designated and pre-selected retailing area.

It is important in such display/vending environments and systems that each item be allocated the amount of space for stocking of the particular brand of product which is commensurate with its frequency of sale and consumer demand.

It is recognized that a point-of-purchase vending unit of regularly or uniformly shaped bins has its advantages, but because each item does not require the same space to meet consumer demand, regular or uniform stocking spaces for all goods is unrealistic. That is to say, those goods with high sales activity and demand, and consequently frequently called for by consumers, require more space and those with lower sales demand require commensurately less space. Because new items are always being added and demand for some older items falls, the vending/shelving systems require constant adjustment to accommodate and provide the required space for consumer display of particular goods. This holds true for consumer point-of-purchase vending situations, as well as in a retail sales clerk-assisted situations where the clerk must have the largest variety of goods available for sale within easy reach.

While open shelves might eliminate the problem of regularly-shaped bins or spaces, separators have been found to be necessary to keep each item of stock neatly segregated from other items. Desirably, since demand changes, moveable separators would be the most advantageous. Similarly, it would be desirable to develop a system that could be used in conjunction with existing open shelf space of varying heights or vertical spacing between the shelves, as well as to develop systems which are specially designed to provide adjustable spacing of height and width. Such separators must, of course, be easy to install or remove without complicated tooling or equipment.

Accordingly, it is an object of the present invention to provide a flexible, moveable separator for storage and shelf separator systems which is readily adjustable to provide variable spacing on a shelf or surface and is easy to install and use by the vendor.

A further object is to provide a removable separator unit and system in which the separator does not take up excessive display space.

A still further object is to provide a moveable and removable separator unit and system that can be adapted to modify existing shelving and display units to provide adjustable point-of-purchase display and vending spaces for consumer vending at minimal cost to the retailer.

SUMMARY OF THE INVENTION

Accordingly, the foregoing, objects are achieved by the present invention which broadly comprises a merchandising display stocking and vending system comprising a moveable separator unit that can be readily affixed to or removed from a shelf or bin in a retail display unit which serves as a separator for merchandise stored on the shelf or the bin.

The invention also includes a separator unit in combination with a separator support and guiding unit, which latter can also function in part as a merchandise support or can be affixed to an existing merchandise supporting surface or bin to provide a means for lateral movement and support for the separator unit operatively engaged therewith.

Broadly, the removable and movable separator element of the present invention comprises a generally flat, T-shaped, support-engaging element or means, the top crossbar or strip of said T-shaped element or means being adapted or formed to engage a supporting and retaining groove, and a continuous coplanar vertical strip element extending downwardly from the crossbar of the T for a predetermined distance, a pair of flat, finger-like strip means, projections or elements, each of which symmetrically and angularly extends from the juncture of the vertical and crossbar components of the T-shaped element to a terminal end portion, said end portions defining points on a line essentially parallel to the top edge of the crossbar of said T-shaped element, and a generally rectangular, flat, strip-like separator element affixed to and extending outwardly in a direction normal to one surface of the vertical bar of the T-shaped element.

The present invention also comprises the combination of the aforedescribed T-shaped movable shelf separator element and a retaining and guiding means comprising a supporting surface for engagement with the other or rearward surface of the T-shaped element and a pair of spaced-apart, parallel C-shaped engaging strip elements affixed to said surface and extending upwardly and outwardly from the surface to define a pair of parallel facing grooves or slots adapted to slidably engage, respectively, the upper edge of the crossbar of the T-shaped element and the terminal ends of the angular projections.

DESCRIPTION

For a more complete understanding of the invention, reference is made to the drawings wherein.

Figure 4:
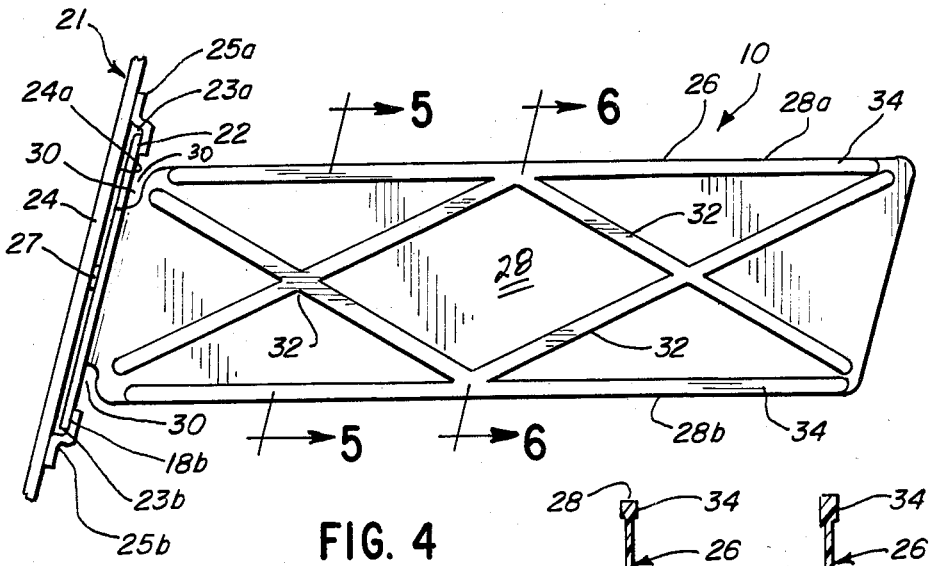
FIG. 4 is a side elevation view in partial section of the shelf engaging and separator unit of FIG. 1 operatively engaged with retaining means on a support surface.
Figure 5:
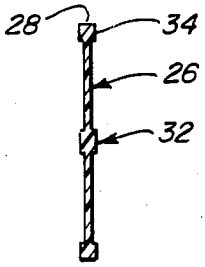
Figure 6:
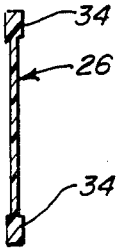
Figure 7:
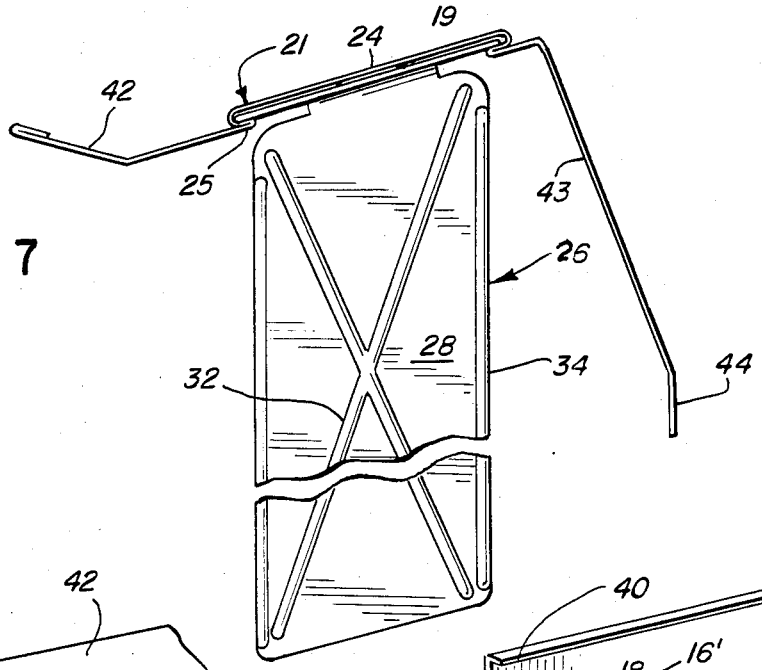
Figure 8:
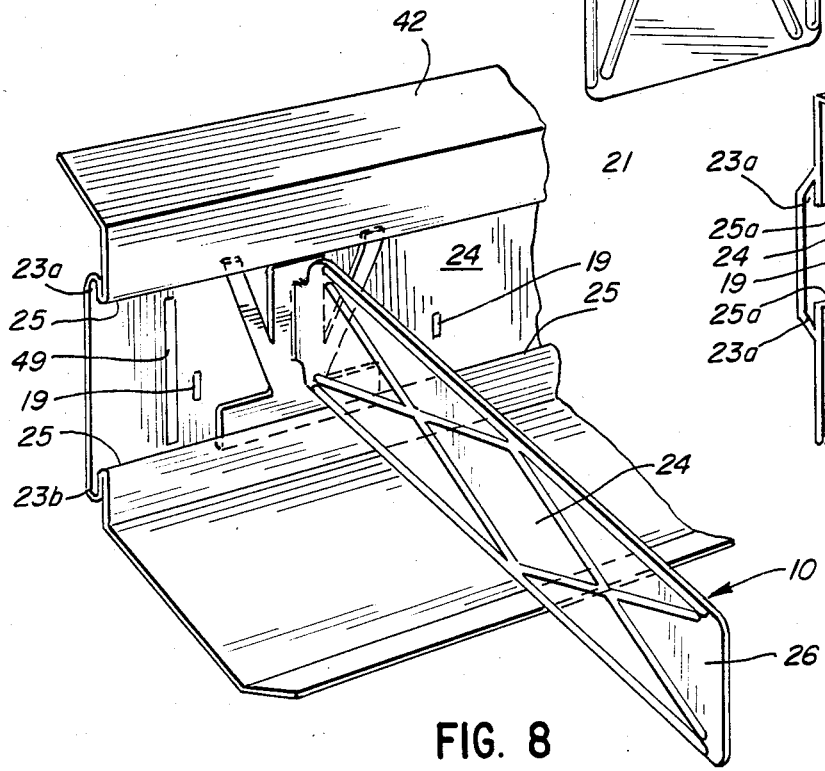
Figure 9:
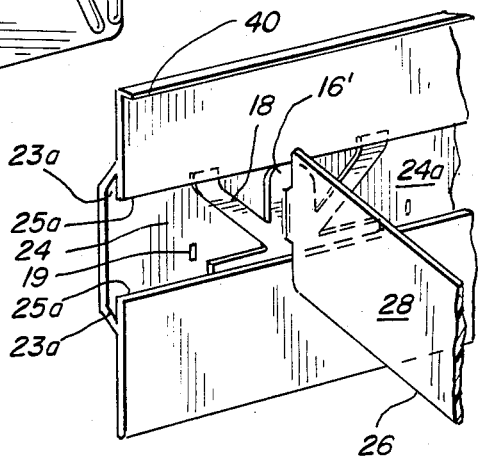
Figure 10:
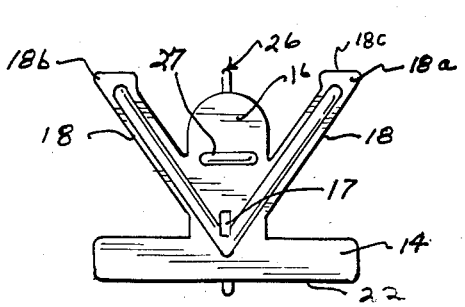
Figure 11:
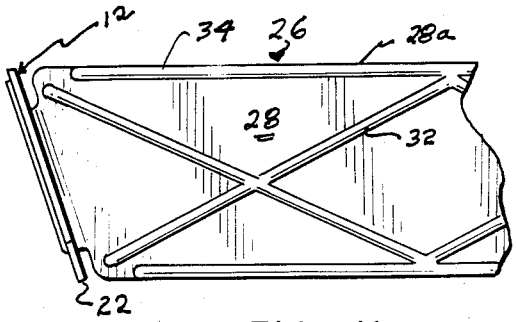
Figure 13:
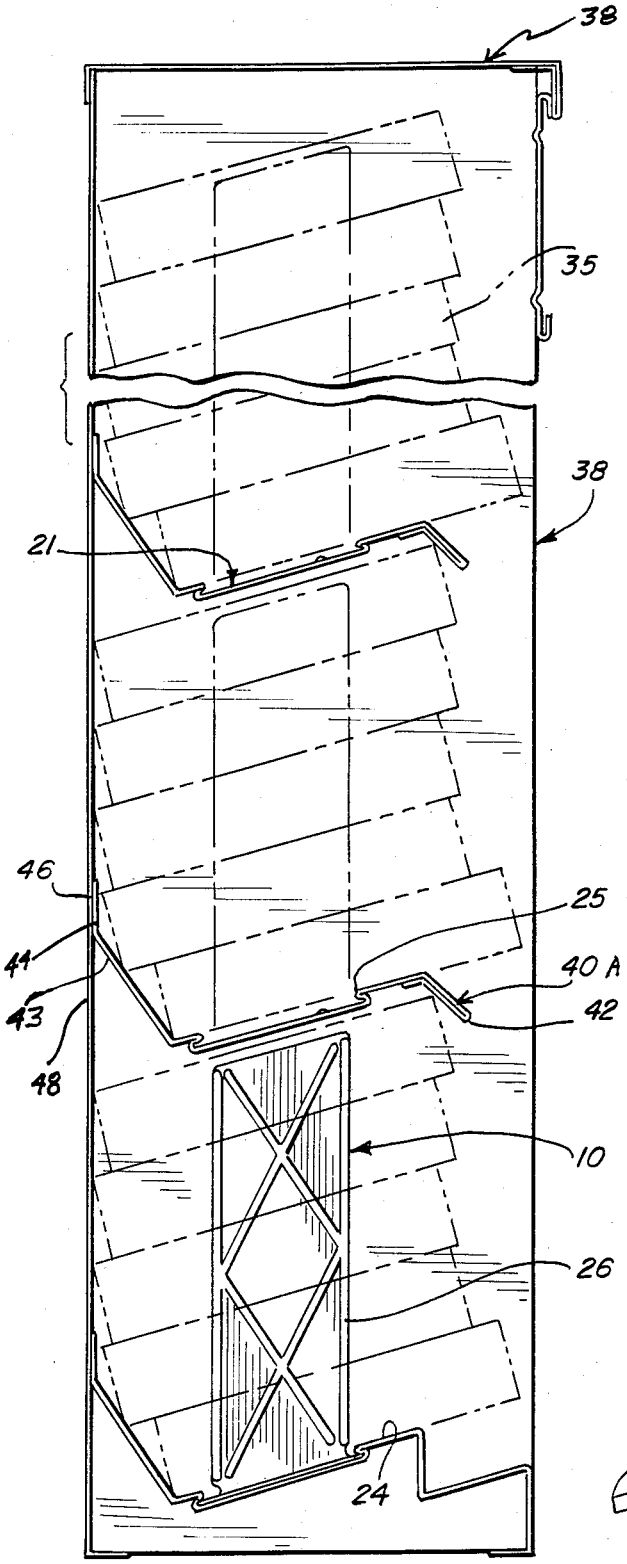
Figure 12:
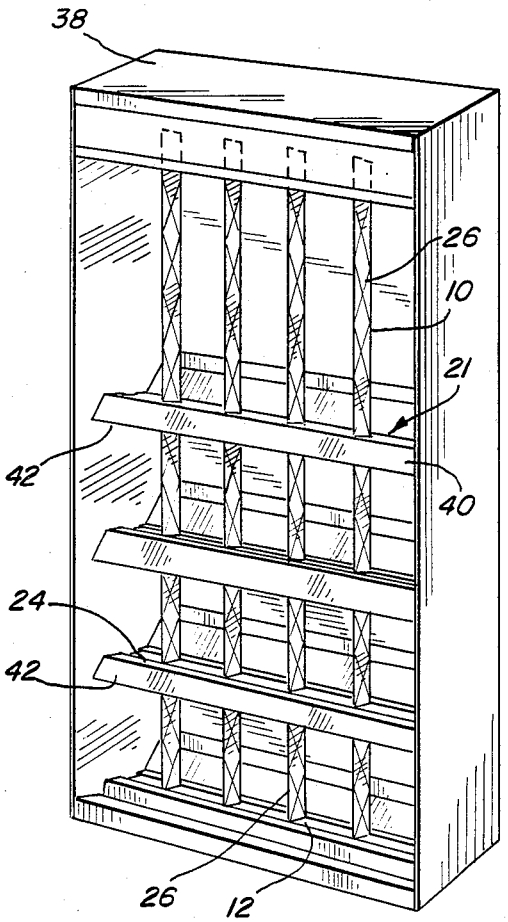
Figure 14:
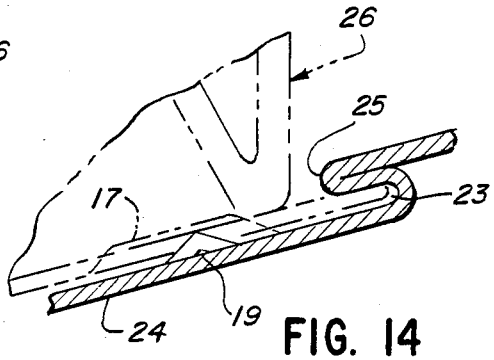
Figure 15:
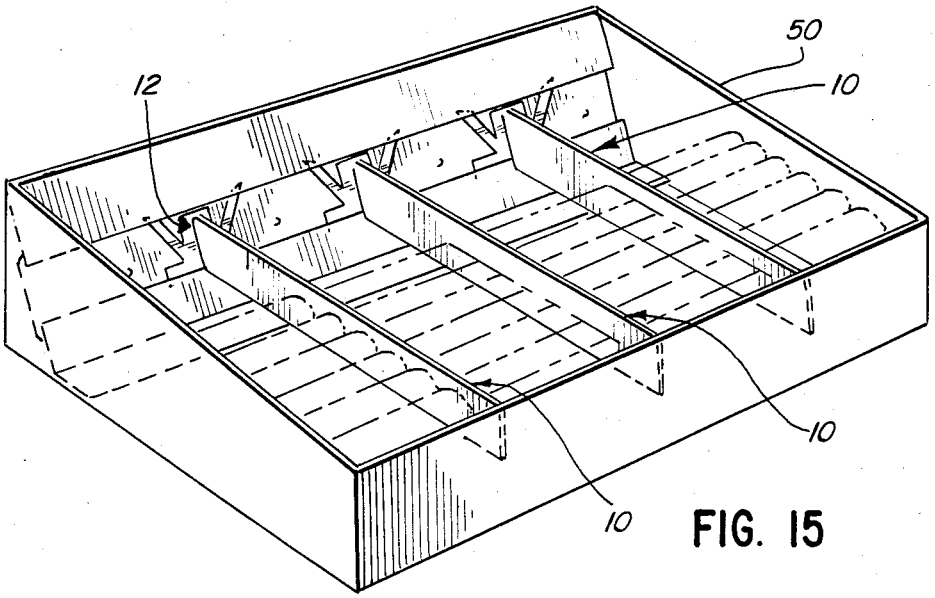
Figure 16:
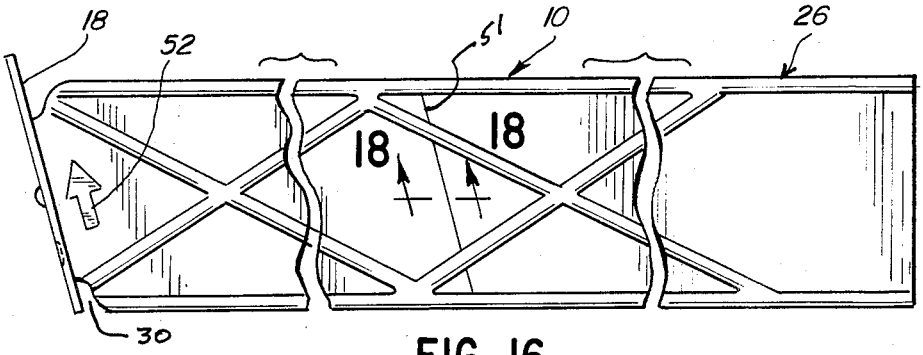
Figure 17:
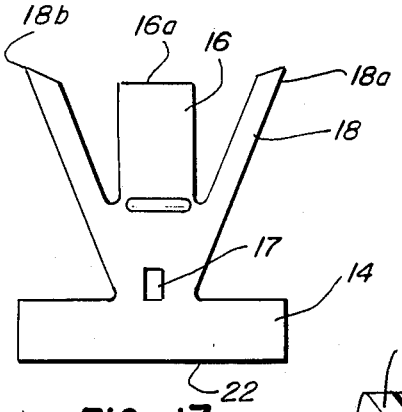
Figure 18:
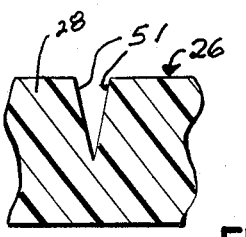
Figure 19:
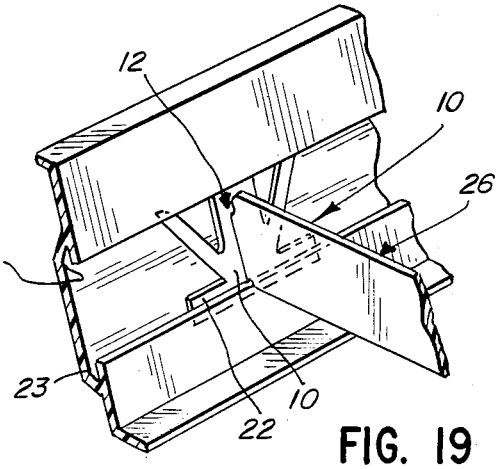

FIGS. 5 and 6 are cross sectional views of the separator unit of FIG. 4 taken along the lines 5—5 and 6—6, respectively, of the separator shown in FIG. 4;

FIG. 7 is a side elevational view in partial section of the shelf and movable separator unit combination with the separator unit depending downwardly;

FIG. 8 is a partial perspective view of an under-shelf, grooved retaining element, and movable separator combination of FIG. 7;

FIG. 9 is a partial perspective view of another form of T-shaped engagement and separator unit engaged with another form of shelf-support unit;

FIG. 10 is an end view of the T-shaped snap-in shelf-engaging element of the separator unit illustrated in FIG. 9;

FIG. 11 is a partial side view of the separator of FIG. 10;

FIG. 12 is a perspective view of a storage and dispensing apparatus with the snap-in separator element in place in a shelf unit;

FIG. 13 is a cut-away sectional side view of FIG. 12 showing the separators in place in a dispensing unit;

FIG. 14 is an enlarged fragmentary sectional view of the separator unit in engagement with a shelf unit of the type illustrated in FIGS. 12 and 13;

FIG. 15 is a perspective view of a box-type horizontally disposed vending unit showing the separators in engagement with securing element on an inner wall surface;

FIGS. 16 and 17 are respectively side and end view illustrations of a further embodiment of the separator unit of the present invention;

FIG. 18 is an enlarged sectional view of a fragmentary partial cross section taken along the lines 18—18 of FIG. 16;

FIG. 19 is a partial perspective view of another type of separator mounted in another modified form of retaining means.

Figure 1:
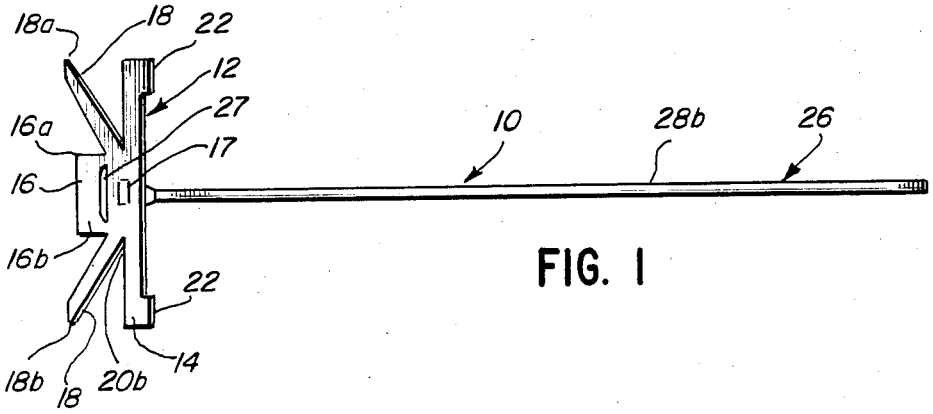
FIG 1 is a top view of the separator unit of the invention tilted to show a partial perspective of the T-shaped shelf engaging element.
Figure 2:
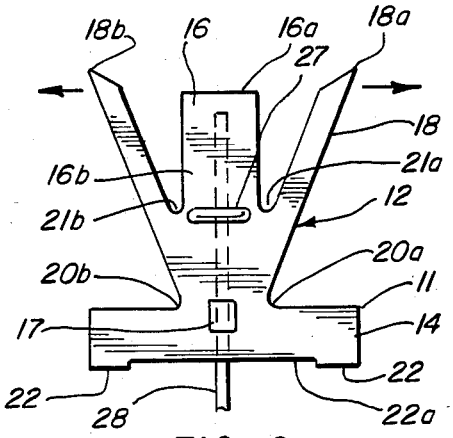
FIG. 2 is an end view of the unit of FIG. 1 showing the one surface of the T-shaped shelf engaging element of the separator unit.
Figure 3:
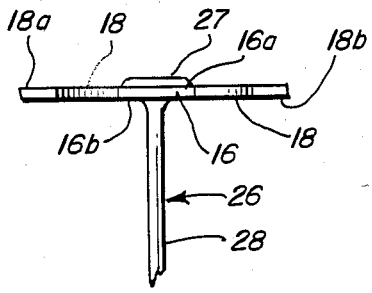
FIG. 3 is a fragmentary top plan view of the separator unit looking downwardly on FIG. 2.

Referring now to the drawings and more particularly to FIGS. 1, 2 and 3, one preferred embodiment of the removable and movable shelf separation unit 10 is shown which includes an inverted T-shaped element 12 comprising a crossbar member 14 and a vertical member 16. A pair of projecting members or fingers 18 of flat strip-like configuration extend angularly, symmetrically and in the same plane as 14 and 16 from the junctures 20*a* and 20*b* of the T-crossbar 14 with the vertical member 16 and extend outwardly and angularly from junctures 21*a* and 21*b* for a predetermined distance to terminal or end portions 18*a* and 18*b*. The ends 18*a* and 18*b* of the angular members 18 are so disposed that a line interconnecting these ends is parallel to the lower edge 22 of the crossbar member 14. See FIGS. 1, 2 and 17. Similarly, the end 16*a* of the vertical member 16 of the T-shaped member 12 also extends upwardly to a point proximate to but short of a line drawn between the ends 18*a* and 18*b* of members 18.

The T-shaped segment 12 and angular members 18 are of generally flat sheet-like or strip construction and all lie in the same plane as shown in FIGS. 1–3. The ends 18*a* and 18*b* of members 18 and the lower edge 22 of crossbar 14 are by virtue of their thin sheet-like form adapted to respectively engage a pair of C-shaped retaining grooves 23*a* and 23*b* formed on a support surface of a retaining and guiding means 21, 24 by strips 25*a* and 25*b* as are illustrated in FIG. 4.

The T-shaped element 12 and angular projections 18 as stated above, are formed of thin sheet-like material which is preferably flexible to permit deformation. Materials such as high impact styrene or ABS polymers (acrylonitrile, butadiene, styrene copolymer) are preferred since they have rigidity and flexibility. Polyolefins such as polypropylene or polyethylene polymers and copolymers thereof are also useful. The separator units are preferably made by molding from high impact styrene polystyrene or ABS polymers which have flexural strength in the area of $300\times10^3$ psi (ASTM D790) or more at 73° F. A particular plastic found useful is a high impact polystyrene made by Huntsman Chemical Corporation called PS-333. Other plastics may also be used which have the necessary rigidity and flexural properties to meet the use requirements of the separator. The flexibility is necessary to permit insertion of the T-shaped element 12 into the grooves 23*a* and 23*b* formed on a support surface 24. While it is, of course, possible to insert the T-shaped unit from one end of the C-shaped grooves 23, it is more desirable and preferred to insert the fastening and support element 12 into the grooves 23 by inserting ends 18*a* and 18*b* in groove 23*a* and by upward pressure on the merchandise separator strip 26 affixed to the rear surface of 16 (see FIG. 4, particularly in the direction of the arrow of FIG. 16), deforming or outwardly bending angular members 18 (in the direction of the arrows shown in FIG. 2) thereby permitting the lower edge 22 of crossbar 14 to snap into the groove 23*b* and, by virtue of their resiliance and flexibility, members or fingers 18 return to their original position when the deformation pressure is released to engage and be retained by the inner part of groove 23*a* in a sliding fit.

While the operational lower edge 22 of crossbar 14 is shown in FIGS. 1 and 2 as having a central notch (22*a*), it may also be straight across as shown in FIGS. 17 and 19. As shown in FIG. 2 one (rear) surface of T-shaped element 12 has a frictional glide 27 located on the back of 16 which engages the surface 24*a* between the grooves 23*a* and 23*b* and bends or bows the flexible and resilient T-shaped element 12 to provide a snug fit in the grooves at ends 18*a* and 18*b* and 22 of crossbar 14 of element 12.

As shown in FIG. 4, the shelf engaging separator device 10 has a generally rectangular product separator element 26 which extends outwardly from the one other surface of the vertical portion 16 of the T-shaped unit. The side surfaces 28 of element 26 are normal to the flat rear surface 16*b* of vertical member 16, however, the upper and lower edges 28*a* and 28*b* may be at either right angles to said surface 16*b* or at an angle of less than 90° (i.e., 70°–85°) to form a slanted or angular juncture to accommodate shelving disposed at an angle to the support surface 24 carrying the retaining members 25 forming grooves 23 for engagement with the top and bottom of the T-shaped element 12 (see FIGS. 4 and 8). The separator element 26 desirably is integrally formed with the T-shaped element 12 as by injection molding and of the same flexible, semi-rigid plastic material such as high impact styrene.

As illustrated, the separator element 26 extending from the T-shaped element 12 has a notch 30 formed at the bottom and top of the attachment of separator 26 to the one surface of element 12. The notch is to allow leeway for some flexing of the angular members 18 on insertion or remove to a point sufficient to clear the end 22 and removal of the unit from the grooves 23*a* and 23*b* and to allow slidable movement of the lower edge 22 of element 12 in the grooves without binding in the retaining means forming the grooves as shown in FIGS. 4 and 8.

Reinforcing ribs 32 are integrally formed in an angular pattern on the surface 28 of *2b* for rigidity as shown in FIGS. 4 and 5. Similar beads 34 are formed for reinforcing the edges of separator 26. Ribs 32 and beads 34 extend slightly above the surface sides of separator 26.

As shown in the drawings, the ends 18*a* and 18*b* of element 18 and the lower edge 22 of T-crossbar 14 are slidable laterally in the grooves 23 formed above the support surface 24 by elements 25. The grooves 23 as illustrated in FIGS. 7 and 8 are integrally formed in those embodiments by metal lips 25 extending outwardly from the sheet forming surface 24 to form the said retaining grooves 23*a* and 23*b*.

FIGS. 7 and 8 illustrate the removable units 12 in place on such a display unit. A plurality of these units can be disposed and spaced in the grooves 23 to accommodate a variety of sizes or amounts of goods. The member 16 is optionally formed with a depression 17 in its rearward surface 16*a* (see FIGS. 1–4 and 10) which is adapted to locate the separator 10 and element 12 in preselected locations shown as bumps 19 formed on a support surface 24 (see FIGS. 8 and 9) which are fitted to engage the depression 17 and frictionally retain the separator unit in a pre-determined location but can be easily disengaged to obtain other spacing of the units as required.

The construction of the T-shaped element 12 with the fingers 18 with ends 18*a*, together with parallel crossbar edge 22 prevents rotation of separator 26 when inserted in grooves 23.

FIG. 9 illustrates an integrally formed plastic extrusion with support surfaces 24*a* and lips 25*a* forming grooves 23*a* in a single extrusion of rigid plastic material, such as rigid polystyrene or ABS copolymer. This unit has an edge or lip 40 extending from one extension of surface 24*a* which would be used to affix the same to a shelf. The device is shown in FIG. 9 can be used by affixing the unit to the lower portion of an existing shelf.

FIGS. 10 and 11 are alternate but less preferred forms of the separator 10 shown in FIGS. 1–8 and shown in use in FIG. 9. In FIGS. 10 and 11 the vertical member 16*c*, of T-shaped element 12, has a rounded top and the ends of fingers 18 are formed to provide a flat top surface 18*c* suitable for sliding engagement with retaining grooves 23*a* and 23*b*. The cross-bar 14 of element 12 also has no indent as is shown in FIGS. 1–4.

FIGS. 12 and 13 show a dispensing and sliding device 38 for small square or rectangular boxes such as cigarettes (39). The shelf and goods support elements 40 which also contains the shelf-separator unit engaging means 21 having separator units 10 in place are shown. The shelf elements 40A have a forward lip 42, a support surface 24 and an angled sector 43 for urging goods forward to lip 42 and a rear plate 44 for affixation at 46 to the rear wall 48 of cabinet 38. (See also FIGS. 7 and 8). As can be seen in FIG. 12, the separator units 10 are movable from side to side to accommodate wider packages.

FIG. 14 illustrates in an enlarged partial sectional view, the engagement of the bump or detent 19 which fits into the depression 17 formed in the rear surface of element 16. Detent 19 as shown in FIG. 14 is formed by pressing a sector of the rear surface 24 upwardly.

As shown in FIGS. 12 and 13 the slidable separator units 10 can have extended separator strips 26. If desired the shelf support elements for engaging the T-shaped unit 12 may also be provided with a plurality of slots 49 in surface 24 such as shown in FIG. 8 which permit the separator 26 to enter through another shelf.

FIG. 15 as indicated is an illustration of a box-like display unit 50 horizontally disposed. The separators 10 are affixed to unit 52 which is of the type shown in FIGS. 4–9 and 19.

FIGS. 16 and 17 show alternate embodiments with edges 22 without notching and FIG. 18 is an enlargement of the cross-section of FIG. 16, showing a scoring line in the plastic which permits ready break-off of the separator slip 26 in the event shorter elements are required. The separator 26 is also shown with a molded arrow 52 to provide direction to a user to insert or remove the separators 10 from the retaining grooves 23*c* in a dispensing device.

Generally, the foregoing invention has been found useful in a wide variety of self-serve or point-of-purchase vending displays. It is particularly adaptable too for placement in existing box-like constructions to provide a means of keeping goods separated in areas of pre-selected width which may be adjusted to provide greater or lesser width depending on sales experience.

What is claimed is:

1. A removable and movable shelf separator unit comprising a generally flat inverted T-shaped element formed of flexible semi-rigid plastic material including a crossbar element having an engagement edge and a central vertical element extending at right angles thereto, a pair of finger-like strip elements extending angularly from the juncture of the vertical and crossbar elements and a generally rectangular flat separator element extending outwardly from one surface of the vertical T element and said flat surfaces being essentially parallel to the side edge of said vertical T- element, the terminal ends of the vertical element and the free terminal ends of the angularly disposed finger-like element elements forming a line parallel to a lower engagement edge of the crossbar element and extending beyond the free end of the vertical element.

2. A removable and movable separator unit formed of a semi-rigid, flexible plastic material which comprises a generally flat, inverted T-shaped, support engaging element, the top crossbar strip of said T-shaped element being adapted to engage a supporting and retaining groove, and said T-shaped element having a continuous integral coplanar vertical strip element extending from the central sector of the crossbar of the T for a predetermined distance, a pair of flat, finger-like strip means, each of which symmetrically and angularly extend outwardly and in the same plane from the junctures of the vertical and crossbar components of the T-shaped element to a terminal end portion, said end portions defining points on a line essentially parallel to a lower edge portion of the crossbar of said T-shaped element beyond and proximate the free end of the vertical bar of the T-shaped element, and a generally rectangular, flat, strip-like separator element integrally formed with and having its flat surfaces extending outwardly in a direction essentially normal to one surface of the vertical bar of the T-shaped element parallel to the said edges of said vertical bar of the T-shaped element.

3. The separator of claim 2 which has a locating element formed on the other surface of the vertical strip element.

4. The separator of claim 2 which has a frictional glide formed on the other surface of the vertical strip.

5. The separator unit of claim 2 wherein the separator element has a plurality of integrally formed reinforcing ribs formed therein.

6. The separator unit of claim 1 wherein the lower edge of the crossbar of the T-shaped element is formed to define at least a pair of foot elements which together form a line essentially perpendicular to the axis of the vertical member of the T-shaped element.

7. The combination of a T-shaped movable separator unit and a support and securing unit for engaging therewith, comprising a support surface having a pair of spaced retaining means formed thereon defining a pair of spaced apart parallel retaining grooves and a T-shaped attachment and separation unit formed of flexible, semi-rigid plastic material including an inverted T-shaped element having a crossbar, and extending vertical element integrally formed of flat strip-like configuration and a pair of integrally formed angular fingers projecting angularly from the juncture of the crossbar and vertical element to terminal ends lying substantially in a line beyond the free terminals of the vertical element of the T-shaped element and parallel to the outer bottom edge of the crossbar element, said bottom edge being in sliding engagement with one of the grooves on said support surface and the free ends of said angular finger members being in engagement with the other retaining groove formed on said support surface.

8. The combination of the T-shaped movable shelf separator unit of claim 2 and a supporting, retaining and guiding means comprising a supporting surface for engagement with the rear surface of the T-shaped element and a pair of spaced-apart, parallel C-shaped engaging strip elements affixed to said surface and extending upwardly and outwardly from the surface to define a pair of parallel facing grooves adapted to slidably engage, respectively, the outer edge of the crossbar of the T-shaped element and the terminal ends of the angular projections.

9. The combination of claim 8 which has a detent formed on the support surface for cooperation with a locator element formed on the rear surface of the vertical strip element.

10. In the combination of claim 8, a T-shaped separator unit wherein the line formed by connecting terminal ends of the angularly disposed finger elements is spaced from the terminal free end of the vertical member of the T-shaped member by a distance substantially equal to the depth of an engagement and securing groove formed on the support and retaining surface.

* * * * *